US005338282A

United States Patent [19]

Ferrone

[11] Patent Number: 5,338,282

[45] Date of Patent: Aug. 16, 1994

[54] AUTOMATIC TRIMMING MACHINE

[76] Inventor: Rock A. Ferrone, 1885 Main St., Pittsburgh, Pa. 15215

[21] Appl. No.: 35,462

[22] Filed: Mar. 23, 1993

[51] Int. Cl.[5] ..... B41F 13/56; B65H 35/02; B65H 35/04; B65H 45/28

[52] U.S. Cl. ..... 493/342; 493/357; 493/359

[58] Field of Search ..... 493/342, 356, 357, 358, 493/359, 360; 270/21.1

[56] References Cited

U.S. PATENT DOCUMENTS

| | | | |
|---|---|---|---|
| Re. 3,101 | 8/1968 | Hayes et al. . | |
| 469,543 | 2/1892 | Cook . | |
| 1,658,466 | 2/1928 | Sheldon | 493/357 |
| 1,830,416 | 11/1931 | Wood | 493/357 |
| 1,831,246 | 11/1931 | Hitchcock | 493/342 |
| 2,572,802 | 10/1951 | Crabtree et al. | 493/342 |
| 2,781,095 | 2/1957 | Spinner | 493/342 |
| 3,685,820 | 8/1972 | Surbrook | 493/360 |
| 3,784,187 | 1/1974 | Takayanagi et al. | 493/359 |
| 3,799,536 | 3/1974 | Gregoire | 493/342 |
| 3,843,113 | 10/1974 | Schaffer | 493/357 |
| 3,992,614 | 11/1976 | Buss . | |
| 4,072,887 | 2/1978 | Buschmann et al. . | |
| 4,077,291 | 3/1978 | Obenshain . | |
| 4,102,227 | 7/1978 | Simko . | |
| 4,116,098 | 9/1978 | Suzuki et al. . | |
| 4,252,044 | 2/1981 | Yamashita et al. . | |
| 4,607,552 | 8/1986 | Siler . | |
| 4,649,782 | 3/1987 | Cavagna . | |
| 4,702,134 | 10/1987 | Corley, III . | |
| 5,072,641 | 12/1991 | Urban et al. . | |
| 5,097,732 | 3/1992 | Tahara . | |
| 5,125,301 | 6/1992 | Miller et al. . | |
| 5,170,688 | 12/1992 | Keech et al. | 493/342 |

FOREIGN PATENT DOCUMENTS

| | | | |
|---|---|---|---|
| 2513244 | 10/1975 | Fed. Rep. of Germany | 493/359 |
| 2455513 | 1/1981 | France | 270/21.1 |

*Primary Examiner*—William E. Terrell
*Attorney, Agent, or Firm*—Webb Ziesenheim Bruening Logsdon Orkin & Hanson

[57] ABSTRACT

The automatic trimming machine of the present invention utilizes a conventional web press to print various sizes of postal and insert cards, flyers and coupon books completely on-line. The automatic trimming machine of the present invention includes a device for perforating the paper to define a folding line and a paper folding device for folding the paper along the perforated folding line. A preliminary trimming unit will first trim the left and right sides of the folded paper, including removing the backbone of the folded paper. The severed backbone is then removed from the preliminary trimming unit. The top and bottom edges of the paper are then trimmed to the appropriate size prior to the paper being cut into distinct products in a finish trimming unit. The finish trimming unit includes a plurality of adjustable cutting blades to allow for cutting of various sized products.

14 Claims, 2 Drawing Sheets

AUTOMATIC TRIMMING MACHINE

BACKGROUND OF THE INVENTION

1. Field of the Invention

The present invention relates to automatic trimming machines for web presses and, more specifically, toward the manufacture of various sizes of postal cards, insert cards, flyers, coupon books and the like in an on-line process.

2. Prior Art

The existing processes for printing and cutting small postal cards and the like involve a separate process for cutting the cards after they have been printed. The prior art process involves slitting the paper on a web press into sheets. The slit sheets are then removed from the web press and cut in a separate process. This two step process is somewhat labor intensive and time-consuming.

The object of the present invention is to overcome the aforementioned drawbacks of the prior art. A further object of the present invention is to provide an automatic trimming machine for use with a web press which allows the press to cut various sized postal and insert cards, flyers, coupon books and the like in a single on-line process.

SUMMARY OF THE INVENTION

The present invention provides an automatic trimming machine for use with a web press which is adapted to cut various sizes of postal and insert cards, flyers, coupon books and the like in a single continuous on-line process. The automatic trimming machine of the present invention includes a paper perforation wheel installed on a trolley of a web press. The paper perforation wheel perforates a web of paper along a folding line. A paper folding device will fold the paper along the folding line forming a backbone along a first side of the folded paper.

A folded paper will then proceed to a preliminary trimming unit which trims the folded paper. The preliminary trimming unit includes a first, a second, a third and a fourth knife. The first knife is positioned on a second side of the folded paper for cutting the folded paper to a specified size. The second knife is positioned on the first side of the folded paper for cutting the backbone from the folded paper. The third and fourth knives are positioned to trim the top edge and bottom edge, respectively, from the folded paper. A vacuum removal device is positioned above the second knife for removing the severed backbone.

The paper is then cut into distinct final products in a finish trimming unit. The finish trimming unit represents a separate device which can be attached to the end of a conventional three knife trimmer or similar device. The finish trimming unit includes a frame, with a feeding mechanism mounted on the frame for transporting material to be cut through the finish trimming unit. A lower knife shaft is mounted on the frame below the path of the material through the finish trimming unit, with a plurality of lower knife blades attached to the lower knife shaft at spaced locations. An upper knife shaft is mounted on the frame above the path of the material, with at least one upper knife blade adjustably positioned on the upper knife shaft. A driving mechanism for driving both the upper knife shaft and the lower knife shaft is provided. Additionally, the finish trimming unit includes a knife positioning device for positioning the upper knife blades along the upper knife shaft to cooperate with selective lower knife blades of the plurality of lower knife blades to form at least one knife pair which is adapted to cut the material.

The knife positioning device of the finish trimming unit may include at least one pneumatic cylinder attached to the upper knife shaft and adapted to lift the upper knife shaft to a knife adjustment position, with at least one pneumatic cylinder attached to each of the upper knife blades to adjust the position of the upper knife blade on the upper knife shaft when the upper knife shaft is in the knife adjustment position. In a preferred embodiment of the present invention, the knife positioning device includes a pair of pneumatic cylinders attached to each upper knife blade, with the pair of pneumatic cylinders attached to each upper knife blade on opposed sides of the upper knife shaft. The pneumatic cylinders attached to the upper knife blade are also adapted to maintain an engagement pressure on each upper knife blade during the cutting of the material to maintain engagement between the upper knife blade and the cooperating lower knife blade. All of the pneumatic cylinders may be controlled by a central controller to automate the process.

These and other advantages of the present invention will become apparent in the description of the preferred embodiment in connection with the attached figures, wherein like reference numerals represent like items throughout.

DESCRIPTION OF THE PREFERRED EMBODIMENT

Figure 1:
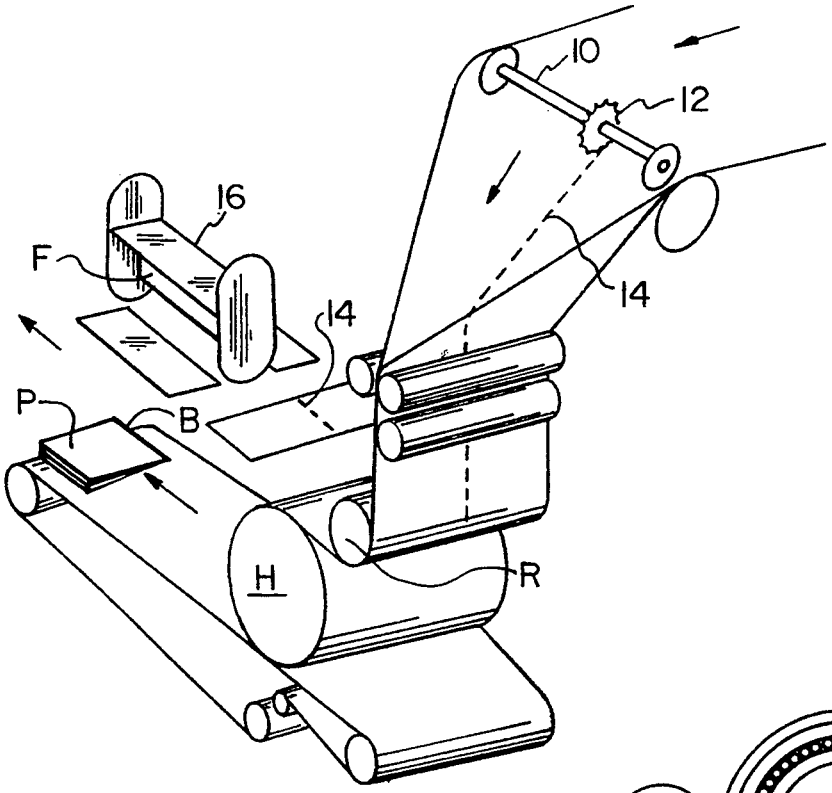
FIG. 1 schematically illustrates the perforating wheel and folding device of the automatic trimming system according to the present invention.

The automatic trimming machine of the present invention allows a conventional web press to cut various sized postal and insert cards, flyers, coupon books and the like in a single on-line process. An important element of the present invention is the perforation process which provides the needed perforated fold line to enable the web of paper to be precisely folded and trimmed. The present invention replaces the slitting wheel (not shown) located on a trolley 10 of a web press with a precisely positioned and machined perforation wheel 12, shown in FIG. 1. The perforation wheel 12 is preferably a machined, stainless steel perforation wheel. Perforation wheel 12 places a perforation in the web of paper along a fold line 14. Perforation of the fold line 14 allows for precise folding of the web of paper and for appropriate trimming of the paper as will be described hereinafter. The perforated web of paper is fed through the web press in the conventional fashion. In the web press, a half drum H cooperates with a roller R to pull the perforated web through the web press and separate the web into a sheet of paper P, such as by a cutter blade (not shown) on the roller R. The paper P will have the perforation along the fold line 14 at the centerline thereof. The perforated sheet of paper P is then fed to a conventional folding unit 16 with folding blade F which will fold the paper P along fold line 14 forming a backbone B, or spine, on one side of the folded paper P. The backbone B is the back of the book or magazine where the pages are connected. With the exception of the perforation wheel 12, the above-described elements of the web press, including the half drum H, the roller R and the folding unit 16 with a folding blade F, are conventional elements well-known in the art operating in a conventional fashion.

Figure 2:
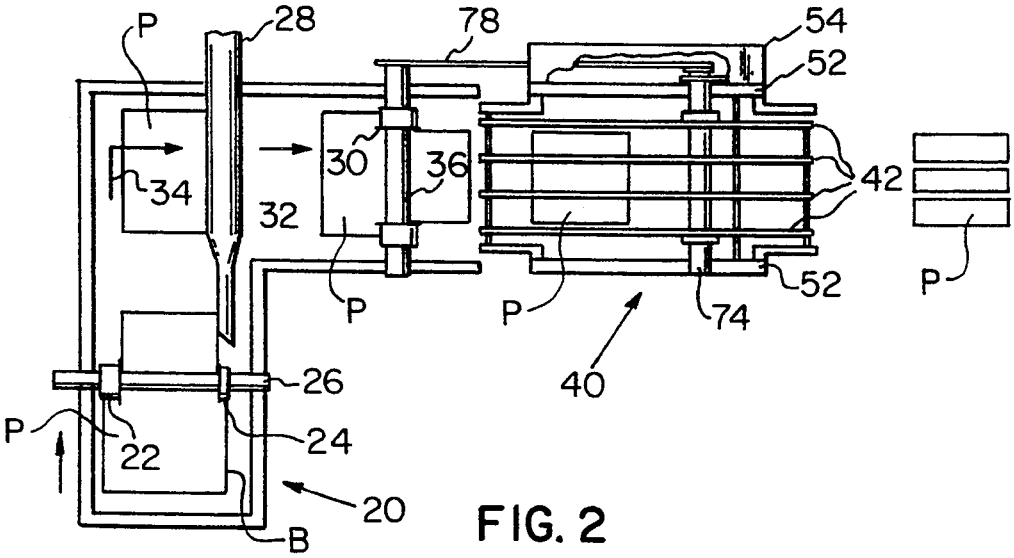
FIG. 2 schematically illustrates a top view of the preliminary trimming unit and the finish trimming unit of the automatic trimming system according to the present invention.

The folded paper P is fed to a preliminary trimming unit 20, shown in FIG. 2. The preliminary trimming unit includes a first knife 22 for trimming the left side of the folded paper P to a specified size. The left side of the folded paper P is opposite the backbone B formed by the folding unit 16. The preliminary trimming unit 20 includes a second knife 24 adapted to sever the backbone B of the folded paper P. Both the first knife 22 and the second knife 24 may be formed as a pair of stainless steel rotary knives positioned above and below the paper to be severed. The upper blades of the first knife 22 and the second knife 24 may be mounted on a single upper blade shaft 26. The lower knife blades of the first knife 22 and the second knife 24 can be mounted on a single lower blade shaft (not shown) mounted below the paper to be severed. Either or both of the upper blade shaft 26 and the lower blade shaft (not shown) may be driven in a conventional fashion.

The cutting of the backbone B of the paper P by the second knife 24 presents some difficulties because of the subsequent need to remove the severed backbone B. The rigidity of the severed backbone B prevents the waste backbone B from being removed by a conventional suction system which is positioned below the preliminary trimming unit 20. A vacuum device is positioned above the second knife 24 for removing the severed backbone. The vacuum device includes a plastic tube assembly 28 attached to a vacuum source (not shown) for removing the severed backbone from above the second knife 24. The plastic tube assembly is positioned at an angle of less than 45° with respect to the horizontal. Additionally, the connections and the ends within the tube assembly 28 are less than 45° . This arrangement eliminates clogging within the plastic tubing and facilitates the removal of the severed backbone. Furthermore, the perforation wheel 12 places perforations along the fold line 14 as described above. These perforations introduce a sufficient amount of flexibility into the severed backbone to allow the backbone to be removed through the plastic tube assembly 28.

The preliminary trimming unit 20 further includes a third knife 30 and a fourth knife 32 which are adapted to sever the top and bottom edges of the folded paper P, respectively. A 90° change in the direction of the transportation of the paper P to be trimmed by the preliminary trimming unit 20 is shown by arrow 34 and occurs between the second knife 24 and the third knife 30. The third knife 30 and the fourth knife 32 may be similar to the first knife 22 and the second knife 24, each including a pair of stainless steel rotary knives positioned above and below material to be trimmed. The upper knife blades of the third knife 30 and the fourth knife 32 can be mounted on a single upper knife shaft 36 which can be driven in a conventional fashion. The lower knife blades (not shown) of the third knife 30 and the fourth knife 32 may be mounted and driven in a similar fashion.

The preliminary trimming unit 20 of the present invention represents a modification of an existing three knife trimming unit. The existing three knife trimming unit basically includes the first knife 22, the third knife 30 and the fourth knife 32. The right side of the folded paper in a conventional three knife trimmer is normally left intact to maintain the backbone connection for the magazine. Consequently, the existing three knife trimmer does not provide a backbone removing second knife 24 or additional backbone removing plastic tube assembly 28.

The trimmed paper P is then fed from the preliminary trimming unit 20 into a finish trimming unit 40 which will cut the paper P into specified sizes appropriate for the finished product as will be described hereinafter.

Figure 3:
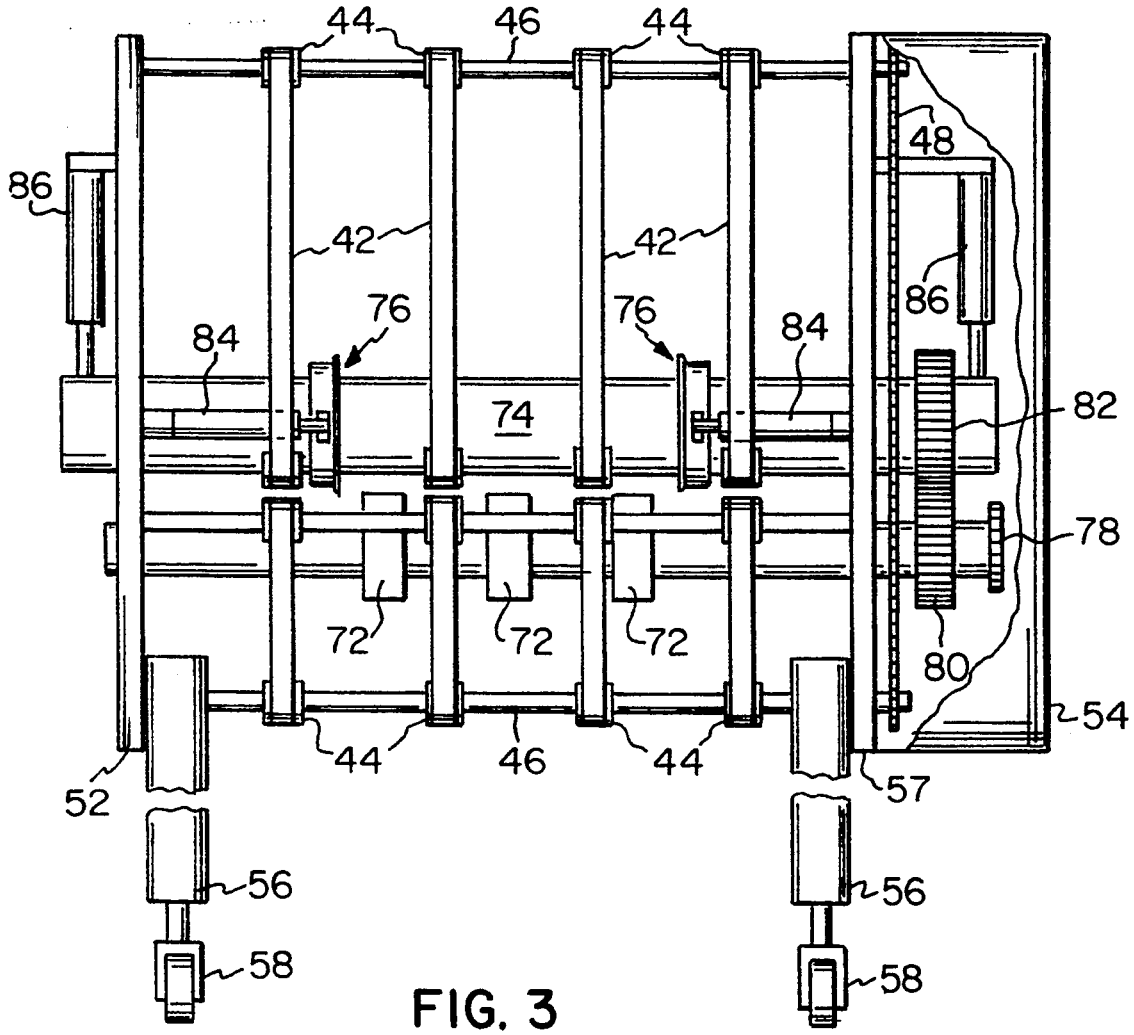
FIG. 3 is a front view of the finish trimming unit of FIG. 2.
Figure 4:
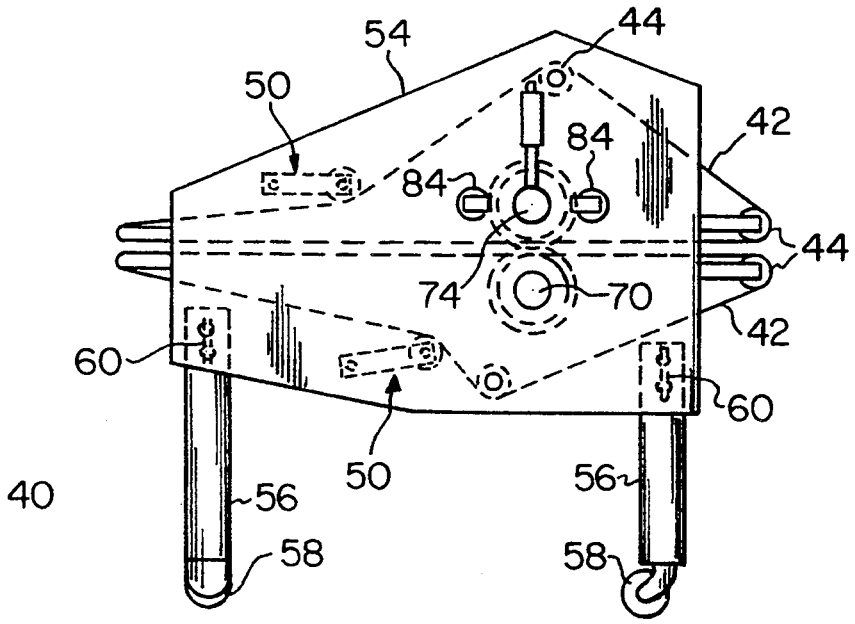
FIG. 4. is a side view of the finish trimming unit of FIGS. 2 and 3.

The paper P to be severed is transported through the finish trimming unit 40 by four pairs of spaced upper and lower nylon drive belts 42. As shown in FIG. 3, each of the drive belts 42 is reeved around a plurality of pulleys 44 coaxially mounted on shafts 46. The shafts 46 can be appropriately driven by a first drive chain 48 appropriately connected to a source of driving power. As shown in FIG. 4, each drive belt 42 includes an appropriate pivotable tensioning roller 50.

As shown in FIG. 3, the frame of the finish trimming unit 40 includes a pair of opposed side frames 52 which support the shafts 46 for the drive belts 42. A protective cover 54 is attached to one of the side frames 52 to protect the enclosed driving assemblies. The side frames 52 are supported by leg members 56 which rest on rollable casters 58. Each of the leg members 56 includes a height adjusting slotted bolt connection 60 to provide for appropriate adjusting of the height of the finish trimming unit 40.

As shown in FIG. 3, the finish trimming unit 40 includes a lower knife shaft 70 mounted between the side frames 52. The lower knife shaft 70 includes three spaced lower rotary knife blades 72 attached at spaced locations to the lower knife shaft 70. The lower knife blades 72 are preferably stainless steel rotary wheels which are keyed to the lower knife shaft 70. These blades 72 are spaced such that the outer lower knife blades 72 will effectively divide the paper being cut into thirds while the center lower knife blade 72 will divide the material being cut substantially in half.

An upper knife shaft 74 extends between the side frames 52. The upper knife shaft 74 slidably receives a pair of upper rotary knife blades 76. The upper rotary knife blades 76 are keyed to the upper knife shaft 74.

The lower knife shaft 70 is driven by a second drive chain 78 which can be coupled to the shaft 36 for the third knife 30 and fourth knife 32, as shown in FIG. 2. Alternatively, the second drive chain 78 can be driven in any other conventional fashion.

The driving of lower knife shaft 70 will drive the lower knife blades 72 which are keyed thereto. Meshing steel gears 80 and 82 are provided on the lower knife shaft 70 and the upper knife shaft 74, respectively, for driving of the upper knife shaft 74. The driving of the upper knife shaft 74 will forcibly drive the upper knife blades 76 which are keyed thereto.

Figure 5:
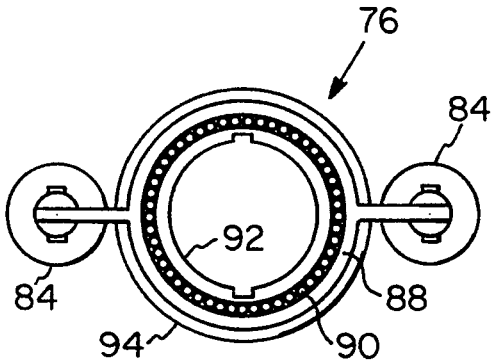
FIG. 5 is an enlarged side view of the upper blade arrangement of the finish trimming unit shown in FIGS. 2–4.

As shown in FIGS. 3-5, each upper knife blade is slidably positioned on the upper knife shaft 74 by a pair of pneumatic cylinders 84 positioned on opposed sides of the upper knife shaft 74. Lifting pneumatic cylinders 86 are attached to opposed sides of the upper knife shaft 74 to provide for lifting of the upper knife shaft 74 into a knife adjustment position. The knife adjustment position allows for the pneumatic cylinders 84 to position the upper knife blade 76 without interfering with the drive belts 42. Furthermore, in operation, the pneumatic cylinders 86 of each of the upper knife blades 76 are adapted to maintain an engagement pressure on the upper knife blades 76 during the cutting of the paper to maintain engagement between the upper knife blade 76 and an associated lower knife blade 72.

FIG. 5 illustrates a more detailed view of the upper knife blades 76. Knife blade 76 includes an attaching assembly 88 attaching to the pneumatic cylinders 84. The attaching assembly 88 is separated by a bearing assembly 90 from the rotary knife housing 92. The rotary knife housing 92 includes notches for being keyed toward the upper knife shaft 74 and directly supports the rotary knife 94. The upper rotary knives are preferably stainless steel rotary knives ground to a sharp finish.

In operation, at least one of the upper knife blades 76 will be cooperating with an associated lower knife blade 72 to format least one rotary knife pair which cuts material passing through the finish trimming unit 40. Generally, the finish trimming unit will be in one of two orientations. Either both upper knife blades 76 will be associated with the outer lower knife blades 72 to form two knife pairs for severing the paper P into thirds or only one of the upper knife blades 76 will be associated with a lower knife blade 72 forming a single knife pair for cutting the paper P in half.

The present invention allows for easy repositioning of the upper knife blades through operation of the pneumatic cylinders 84 and 86. It is anticipated that the pneumatic cylinders 84 and 86 will be appropriately coupled to a central controller to allow the system to automatically change between various set-up arrangements.

It will become apparent to those of ordinary skill in the art that various modifications may be made to the present invention without departing from the spirit and scope thereof. Consequently, the intended scope of the present invention is to be defined by the following claims.

I claim:

1. A trimming system for a web press comprising:
- a paper perforation means for perforating a web of paper along a folding line;
- a means for cutting said web of paper into individual paper sheets;
- a paper folding means for folding the paper sheets along the folding line forming a backbone along a first side of the folded paper; and
- a preliminary trimming unit for trimming the folded paper, said preliminary trimming unit including:
- a first knife means positioned on a second side of the folded paper for cutting the folded paper to a specified size,
- a second knife means positioned on the first side of the folded paper for cutting the backbone from the folded paper,
- a vacuum means positioned above said second knife means for removing the severed backbone,
- a third knife means positioned for cutting a top edge of the folded paper,
- a fourth means positioned for cutting a bottom edge of the folded paper, and
- a finish trimming unit receiving the preliminarily trimmer paper from said preliminary trimming unit and adapted to cut the preliminarily trimmed paper into distinct products.

2. The trimming system of claim 1 wherein said paper perforation means includes a perforation wheel on a trolley of the web press.

3. The trimming system of claim 1 wherein said second knife means includes a pair of rotary blades positioned above and below the path of the folded paper.

4. The trimming system of claim 1 wherein said vacuum means includes plastic tubing connected to a vacuum source wherein said plastic tubing forms an angle of less than 45° with respect to the horizontal.

5. The trimming system of claim 1 wherein said preliminary trimming unit includes a substantially 90° turn in the direction of transportation of the folded paper between said second knife means and said third knife means.

6. The trimming system of claim 1 wherein said finish trimming unit includes:
- a frame;
- a feeding means mounted on said frame for transporting the preliminarily trimmed paper through said finish trimming unit;
- a lower knife shaft mounted on said frame below the path of the paper through said finish trimming unit;
- a plurality of lower knife blades attached to said lower knife shaft at spaced locations;
- an upper knife shaft mounted on said frame above the path of the paper;
- at least one upper knife blade adjustably positioned on said upper knife shaft;
- a driving means for driving said upper knife shaft and said lower knife shaft; and
- a knife positioning means for positioning said at least one upper knife blade along said upper knife shaft to cooperate with selective lower knife blades of said plurality of lower knife blades to form at least one knife pair adapted to cut the paper.

7. The trimming system of claim 6 wherein said feeding means includes a plurality of spaced upper and lower drive belts.

8. The trimming system of claim 6 wherein said knife positioning means includes at least one pneumatic cylinder attached to said upper knife shaft adapted to lift said upper knife shaft to a knife adjusting position; and
- at least one pneumatic cylinder attached to each said upper knife blade to adjust the position of said upper knife blade on said upper knife shaft when said upper knife shaft is in said knife adjustment position.

9. The trimming system of claim 8 wherein said knife positioning means includes a pair of said pneumatic cylinders attached to each said upper knife blade, with said pair of pneumatic cylinders attached to each said upper knife blade on opposed sides of said upper knife shaft.

10. The trimming system of claim 8 wherein said at least one pneumatic cylinder of each said upper knife blade is adapted to maintain an engagement pressure on said upper knife blade during the cutting of the paper to maintain engagement between said upper knife blade and said cooperating lower knife blade.

11. The trimming system of claim 6 wherein a pair of said upper knife blades and three said lower knife blades are provided.

12. The trimming system of claim 6 wherein said frame includes supporting leg members with adjustable height means and castors supporting said leg members.

13. The trimming system of claim 6 wherein said driving means includes a drive chain coupled to a driving device for said third knife means and said fourth knife means of said preliminary trimming unit.

14. A method of trimming printed articles from a web press comprising:

a) perforating a web of paper along a folding line and cutting the web of paper into individual paper sheets;

b) folding said paper sheets along said folding line forming a backbone along a first side of said folded paper;

c) cutting a second side of said folded paper with a first knife means;

d) cutting said backbone from said folded paper with a second knife means;

e) removing said severed backbone form above said second knife means;

f) cutting a top edge of said folded paper with a third knife means;

g) cutting a bottom edge of said folded paper with a fourth knife means; and h) cutting said folded paper into distinct products in a finish trimming unit.

* * * * *